US005447572A

United States Patent [19]

LaClair

[11] Patent Number: 5,447,572

[45] Date of Patent: Sep. 5, 1995

[54] METHOD FOR REMOVING DEBRIS FROM BARREL LOCKS

[75] Inventor: Betty J. LaClair, Lavaca, Ark.

[73] Assignee: Oklahoma Gas & Electric Company, Oklahoma City, Okla.

[21] Appl. No.: 130,161

[22] Filed: Sep. 30, 1993

Related U.S. Application Data

[62] Division of Ser. No. 832,111, Feb. 6, 1992, abandoned.

[51] Int. Cl.[6] ..... B08B 1/00; B08B 9/00

[52] U.S. Cl. ..... 134/8; 134/22.1; 134/22.11; 15/104.011; 15/105

[58] Field of Search ..... 134/22.1, 22.11, 8; 15/105, 111, 106, 104.011, 184

[56] References Cited

U.S. PATENT DOCUMENTS

| | | | |
|---|---|---|---|
| D. 296,271 | 6/1988 | Kobayashi . | |
| D. 298,855 | 12/1988 | White . | |
| 1,776,443 | 9/1930 | Martin | 15/111 |
| 2,309,677 | 2/1943 | Segal . | |
| 2,371,534 | 3/1945 | McGrath . | |
| 2,682,072 | 6/1954 | Green | 15/111 |
| 2,739,330 | 3/1956 | Hitchcock . | |
| 2,897,525 | 8/1959 | Goodwin et al. | 15/104.165 |
| 3,086,384 | 4/1963 | Wyche . | |
| 3,835,674 | 9/1974 | Hoyt . | |
| 3,863,286 | 2/1975 | Puckett | 15/104.011 |
| 4,058,992 | 11/1977 | Nielsen, Jr. . | |
| 4,222,143 | 9/1980 | Tarrson et al. | 15/105 |
| 4,247,753 | 1/1981 | Jaronen . | |
| 4,289,000 | 9/1981 | Nielsen, Jr. | 70/34 |
| 4,303,825 | 12/1981 | Jaronen . | |
| 4,635,452 | 1/1987 | Agbay | 70/34 |
| 4,674,218 | 6/1987 | Bottomley | 15/104.05 |
| 4,712,395 | 12/1987 | Agbay | 70/34 |
| 4,742,703 | 5/1988 | DeWalch et al. | 70/366 |
| 4,754,764 | 7/1988 | Bayne . | |
| 4,828,300 | 5/1989 | Agbay | 292/256.6 |
| 4,899,409 | 2/1990 | Cox, Jr. | 15/104.04 |
| 4,911,187 | 3/1990 | Castillo | 132/321 |

FOREIGN PATENT DOCUMENTS

| | | | |
|---|---|---|---|
| 96909 | 11/1922 | Switzerland | 7/167 |
| 746649 | 3/1956 | United Kingdom | 15/111 |

*Primary Examiner*—Scott Kastler
*Assistant Examiner*—Zeinab El-Arini
*Attorney, Agent, or Firm*—Dunlap & Codding

[57] ABSTRACT

An apparatus and method for removing debris from the bore of a barrel lock is disclosed. The apparatus is a cleaning tool comprising a handle, the handle having a first end having a rod with a sharp end for picking and dislodging debris and a second end having a rod with a brush for clearing away the debris. The apparatus comprises several alternative types of handles including a hollow handle for storing detachable rods. The rods may be permanently or detachably connected to the handle. The sharp end of the rod may be curved. The invention comprises several means for detachably connecting the rods to the handle.

5 Claims, 3 Drawing Sheets

METHOD FOR REMOVING DEBRIS FROM BARREL LOCKS

This is a divisional of application Ser. No. 07/832,111 filed on Feb. 6, 1992, entitled "TOOL FOR REMOVING DEBRIS FROM BARREL LOCKS" now abandoned.

BACKGROUND OF THE INVENTION

RELATED REFERENCES

Barrel type locks such as those of the construction shown in U.S. Pat. Nos. 3,835,674 issued to Hoyt, 4,058,992 and 4,289,000 issued to Nielson and 4,635,452 and 4,712,395 issued to Agbay, the disclosures of which are hereby specifically incorporated herein by reference, are widely known by those knowledgeable in the art and are widely used by gas and electric service companies for shut-off valves, electric meters, switches, and other devices designed to be operated solely by authorized personnel. In a typical configuration, a barrel lock is used to resiliently close and lock a retaining ring, an example of which is shown in U.S. Pat. No. 4,828,300 issued to Agbay (the disclosure of which is hereby specifically incorporated herein by reference). A retaining ring is secured around the housing of an electric meter cover with a barrel lock so as to connect the housing to a meter box and to prevent tampering of the meter by unauthorized personnel. In order to be unlocked, a special key is inserted into a narrow bore in the lock. The key disengages a pair of spring loaded ball bearings in the lock, thereby unlocking the device. However, the bore of the lock is relatively narrow. It is not uncommon for dirt, dust, insects and other forms of debris to accumulate over time within the bore, thereby causing the bore to be obstructed and preventing the effective insertion of the key at such time as the lock is desired to be opened. The key itself comprises no means for clearing the bore of debris. Often the only means for removing a lock in this obstructed condition is by cutting it off. This results in loss of time for the personnel and in loss of money due to the required replacement of the destroyed barrel lock. A device specifically designed to clean the bore and remove debris prior to insertion of the lock would be very beneficial by allowing a more efficient and economical removal of the locks. No such cleaning tool which is designed to perform this function is currently commercially available.

FIELD OF THE INVENTION

This invention relates to tools or devices designed to clean or remove debris from narrow apertures or bores and methods for doing such. In particular, the device relates to tools designed to remove debris from the bores of barrel locks.

BRIEF DESCRIPTION OF THE DRAWINGS

FIG. 6 Perspective view of a version of the tool having connectable picking rod and brushing rod.

DESCRIPTION OF THE PREFERRED EMBODIMENTS

The invention is a cleaning apparatus or tool which is designed to clear debris from a bore of a barrel lock, and a method for cleaning a bore of a barrel lock. The tool comprises a handle having attached one rod which has a sharp, slightly curved point for picking and another rod which has a brush on the end.

Figure 1:
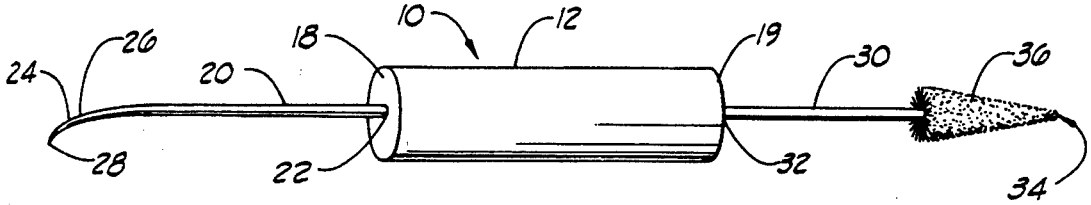
FIG. 1 Perspective view of tool having a picking rod and a brushing rod attached to each end of the tool handle.

Embodiment of FIG. 1

In one preferred embodiment, the present invention, designated generally by the reference numeral 10, is a cleaning apparatus or tool for cleaning a bore in a barrel lock which will be described in detail below. The tool 10 has a handle 12 having a generally elongated cylindrical shape. The handle 12 is easily held in the palm of an individual's hand. It is noted here that the handles described in the figures herein will generally be characterized as having a cylindrical shape with a circular cross section, but it will be understood that other elongate handle shapes with geometric cross sections such as square, rectangular, hexagonal, and triangular are also compatible with the function of the apparatus. The handle 12 has a first end 18 and a second end 19, the handle 12 capable of receiving a rod assembly where the rod assembly is comprised of a first rod 20 and a second rod 30.

The first rod 20 of the rod assembly, also referred to as the picking rod 20, has a first end 22 and a second end 24. The first end 22 of the first rod 20 is permanently attached to the first end 18 of the handle 12. The second end 24 of the first rod 20 has a sharp point 28 and has a slight curve 26 near the second end 24.

The second rod 30 of the rod assembly, also referred to as the brushing rod 30, has a first end 32 and a second end 34. The first 32 end of the second rod 30 is permanently attached to the second end 19 of the handle 12. The second end 34 of the second rod 30 is equipped with a narrow brush 36 which is sufficiently narrow to allow the brush 36 to be inserted into a bore in a barrel lock.

Figure 2:
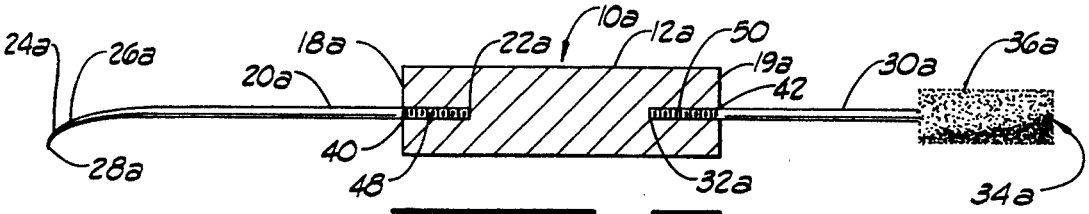
FIG. 2 Cross-sectional view of tool having a picking end and brushing end screwed into tool handle.

The brush may be a tapered brush 36, tapering to a near point at the end 34 as indicated in FIG. 1 or it may be a barrel-shaped brush **36*a* as indicated in FIG. 2**. The brush may take on other configurations or shapes (not shown) which would allow the brush to more closely adapt to the shape of a particular bore of a particular barrel lock.

The handle 12, the first rod 20 and the second rod 30 and the brush 36 on the rod 30 may be comprised of a material selected from the group consisting of metal, plastic, polymer or any combination thereof. In a preferred embodiment, the brush 36 is comprised of a plurality of short metal bristles.

Embodiment of FIG. 2

Figure 3A:
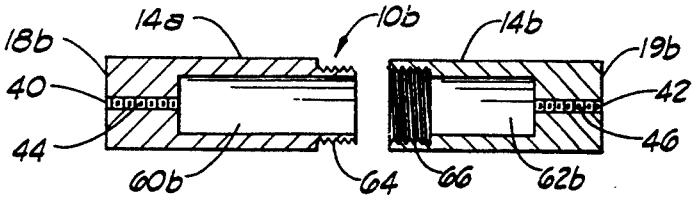
FIG. 3A Cross-sectional view of a separated tool handle having a hollow central storage cavity.

In another embodiment as shown in FIG. 2, the apparatus 10*a* is constructed the same as apparatus 10, with a handle 12*a* having a first end 18*a* and a second end 19*a*, a first rod 20*a* having a first end 22*a* and a second end 24*a* with a point 28*a* and a slight curve 26*a*, and a second rod 30*a* having a first end 32*a* and a second end 34*a* having a brush 36*a*, except that the first rod 20*a* and the second rod 30*a* are both detachable and attachable to the first end 18*a* and the second end 19*a* of the handle 12*a*, respectively. This feature facilitates the removal and replacement of a broken or faulty first rod 20*a* or second rod 30*a*. In the embodiment of the apparatus 10*a*, the first end 18*a* of the handle 12*a* is provided with a hole 40 having grooves 44 therein (as shown in FIG. 3A) and the second end 19*a* of the handle 12*a* is provided with a hole 42 having grooves 46 therein (as shown in FIG. 3A). The first end 22*a* of the first rod 20*a* has threads 48 and the first end 32*a* of the second rod 30*a* has threads 50 such that the first end 22*a* of the first rod 20*a* can be rotatably or screwably connected to the first end 18*a* of the handle 12*a* and the first end 32*a* of the second rod 30*a* can be rotatably or screwably connected to the second end 19*a* of the handle 12*a*. In a similar but opposite way, the first rod 20*a* can be rotatably or screwably disconnected from the first end 18*a* of the handle 12*a* and the first end 32*a* of the second rod 30*a* can be rotatably or screwably disconnected from the second end 19*a* of the handle 12*a*.

Figure 3B:
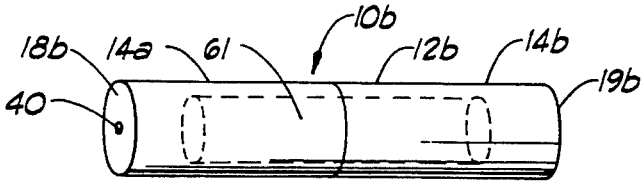
FIG. 3B Perspective interior view of hollow central storage cavity in tool handle.

Embodiment of FIGS. 3A and 3B

Shown in FIGS. 3A and 3B is another embodiment of a cleaning tool 10*b* which is constructed exactly like the cleaning tool 10*a* shown in FIG. 2 and described in detail previously, except that the handle 12*b*, which has a first end 18*b* and a second end 19*b*, has a hollow interior cavity 61 which is sufficiently sized to accomodate both the picking rod 20*a* and the brushing rod 30*a* for storage. As shown in FIG. 3A, in the apparatus 10*b*, the handle 12*b* further comprises a first hollow cylinder 14*a* having a first end 18*b*, and an interior cavity 60*b* which is open at a second end 64 and a second hollow cylinder 14*b* having an interior cavity 62*b* which is open at a first end 66 and having a second end 19*b*. The end 64 of the first cylinder 14*a* is able to be connected, for example by screwing, to the first end 66 of the second cylinder 14*b* such that a single hollow cylinder 12*b* having an interior cavity 61 is formed when the first cylinder 14*a* and the second cylinder 14*b* are connected or screwed together. The cavity 61 within the handle 12*b* is adequately sized to permit storage of the first rod 20*a* and second rod 30*a*. The first rod 20*a* can be screwably connected to the first end 18*b* of handle 12*b* and the second rod 30*a* can be screwably connected to the second end 19*b* of handle 12*b* to form a tool 10*b* in the same manner as tool 10*a* is formed as described previously. It will be understood by those knowledgable in the art that the first cylinder 14*a* and the second cylinder 14*b* may be connected by means other than the screwing means indicated in FIG. 3A. For example, the first cylinder 14*a* and the second cylinder 14*b* may be connected by connecting means which snap together (not shown).

Figure 4:
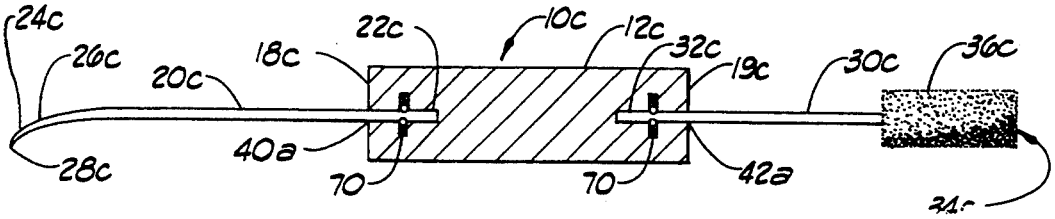
FIG. 4 Cross-sectional view of a tool handle having spring-loaded coupling means.
Figure 4A:
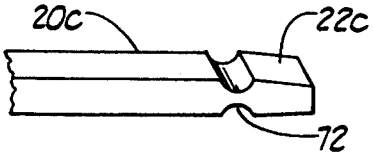
FIG. 4A Perspective view of rod end for engaging coupling means.

Embodiment of FIG. 4 and 4A

In another embodiment, the apparatus 10*c* shown in FIG. 4, also has detachable rods. In the apparatus 10*c*, the first end 18*c* of the handle 12*c* has a first socket 40*a* having a coupling means 70 therein and the second end 19*c* of the handle 12*c* has a second socket 42*a* having a coupling means 70. The first end 22*c* of the first rod 20*c* is provided with engaging means 72 (a preferred version of the engaging means 72 are indicated in FIG. 4A as grooves or depressions) to engage the coupling means 70 of the first end 18*c* of the handle 12*c* such that the first rod 20*c* becomes rigidly attached to the handle 12*c* when the rod 20*c* is inserted into the first socket 40*a*. Similarly, the first end 32*c* of the second rod 30*c* is provided with engaging means 72 (such as that shown in FIG. 4A) to engage the coupling means 70 of the second end 19*c* of the handle 12*c* such that the second rod 30*c* becomes rigidly attached to the handle 12*c* when the rod 30*c* is inserted into the second socket 42*a*.

In a preferred embodiment, the coupling means 70 is a spring-loaded ball bearing system as shown in FIG. 4, such that when the first rod 20*c* is inserted into the first socket 40*a*, the ball bearings of the coupling means 70 in the first socket 40*a* engage the engaging means 72 of the first rod 20*c* to prevent the first rod 20*c* from slipping easily out of the first socket 40*a* of the handle 12*c* and when the second rod 30*c* is inserted into the second socket 42*a* the ball bearings of the coupling means 70 of the second socket 42*a* engage the engaging means 72 of the second rod 30*c* to prevent the second rod 30*c* from slipping easily out of the second socket 42*a* of the handle 12*c*. Moreover, both the first rod 20*c* and the second rod 30*c* have some non-circular or non-cylindrical shape such as the rectangular shape indicated in FIG. 4A such that when the first rod 20*c* and the second rod 30*c* are inserted into the handle 12*c* and used in barrel lock cleaning operations, neither the first rod 20*c* twists or slips within the first socket 40*a* of the handle 12*c* nor the second rod 30*c* twists or slips within the second socket 42*a* of the handle 12*c*.

Figure 5:
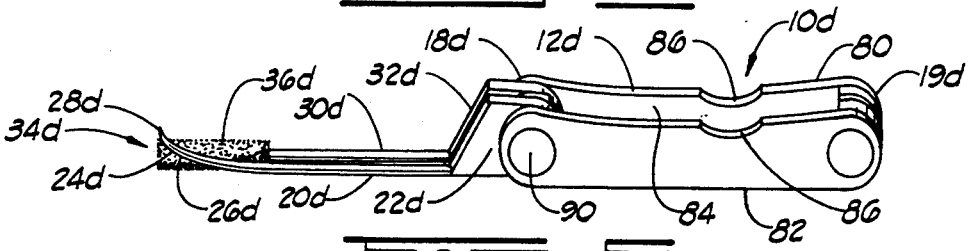
FIG. 5 Perspective view of a version of the tool having picking rod and brush rod connected to a slotted handle.
Figure 5:
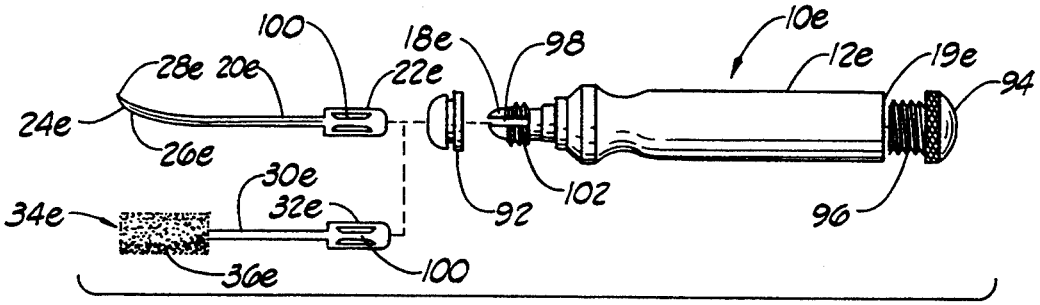

Embodiment of FIG. 5

Another version of the tool, the apparatus 10*d*, as shown in FIG. 5, embodies a handle 12*d* in which both rod 20*d* and 30*d* are permanently attached to the first end 18*d* of the handle 12*d*. In this embodiment, the handle 12*d* further comprises a first side 80 and a second side 82, wherein the first side 80 has a slot 84 which extends from the first end 18*d* of the handle 12*d* to near the second end 19*d* of the handle 12*d* and extends a distance into the handle 12*d*. The slot 84 is sufficiently sized and adapted to receive and hold the first rod 20*d* and receive and hold the second rod 30*d* within the handle 12*d* as well. The first rod 20*d* extends outward from the first end 18*d* of the handle 12*d* and is pivotally attached at the first end 22*d* by a dowel 90 and is capable of being locked into place for usage and unlockable and pivotable for retraction into the slot 84 for storage. The second rod 30*d* extends outward from the first end 18*d* of the handle 12*d* and is also pivotally attached at the first end 32*d* by the dowel 90 and is capable of being locked into place for usage and unlockable and pivotable for retraction into the slot 84 for storage. Depressions 86 are provided in the first side 80 of the handle 12*d* for the purpose of making it easier to manually remove either the first rod 20*d* or the second rod 30*d* from the storage position within the slot 84. In a slight variation of this embodiment (not shown) the first rod 20*d* and the second rod 30*d* may not be attached to the same end 18*d* of the handle 12*d*, but instead the first rod 20*d* may be attached to the first end 18*d* of the handle 12*d* and the second rod may be attached to the second end 19*d* of the handle 12*d*.

Figure 6A:
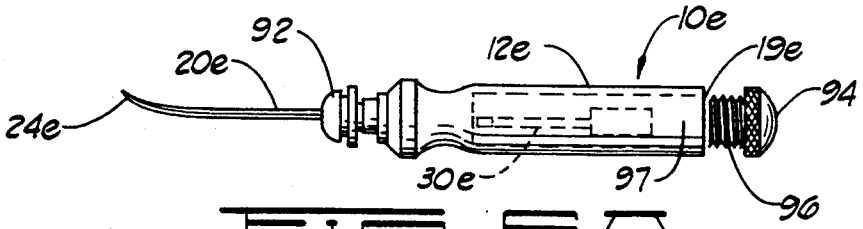
FIG. 6A Perspective view of version of tool having only picking-rod attached to it.

Embodiment of FIGS. 6 and 6A

In another embodiment, the apparatus 10*e*, shown in FIGS. 6 and 6A, has a first rod 20*e* which can be attached and detached from handle 12*e* and a second rod 30*e* which can be attached and detached from handle 12*e*. The first end 18*e* of the handle 12*e* is capable of receiving an external securing means for rigidly securing the first end 22*e* of the first rod 20*e* to the first end 18*e* of the handle 12*e*. Alternatively, the first end 18*e* of the handle 12*e* is capable of receiving an external securing means for rigidly securing the first end 32*e* of the second rod 30*e* to the first end 18*e* of the handle 12*e*. Also, the second end 19*e* of the handle 12*e* is capable of receiving a screw-on cover 94 having threads 96. Finally, the handle 12*e* has a hollow interior cavity 97 which is sufficiently sized to permit storage of the first rod 20*e* when the first rod 20*e* is not in use or the second rod 30*e* when the second rod 30*e* is not in use or both the first rod 20*e* and the second rod 30*e* when the first rod 20*e* is not in use and the second rod 30*e* is not in use.

In a preferred embodiment as indicated in FIG. 6, the first end 18*e* of the handle 12*e* has a slot 98 and threads 102. The first end 22*e* of the first rod 20*e* and the first end 32*e* of the second rod 30*e* each has a flange 100. The flange 100 is adapted to be inserted into the slot 98 prior to the application of an external securing means over the threads 102. The external securing means is a ring nut 92 which can be screwed over the threads 102 of the receiving first end 18*e* of the handle 12*e* and over the first end 22*e* of the first rod 20*e*, thereby rigidly connecting the first end 22*e* of the rod 20*e* to the first end 18*e* of the handle 12*e*. In an identical manner, the ring nut 92 can be screwed over the threads 102 of the receiving first end 18*e* of the handle 12*e* and over the first end 32*e* of the second rod 30*e*, thereby rigidly connecting the first end 32*e* of the second rod 30*e* to the first end 18*e* of the handle 12*e*. FIG. 6A shows the case when the first end 22*e* of the first rod 20*e* is connected to the handle 12*e* using the ring nut 92 as an external securing means. Also shown in FIG. 6A is the second rod 30*e* in the storage cavity 97 within the handle 12*e* of the tool 10*e*.

Embodiments of FIGS. 7–10

Figure 9:
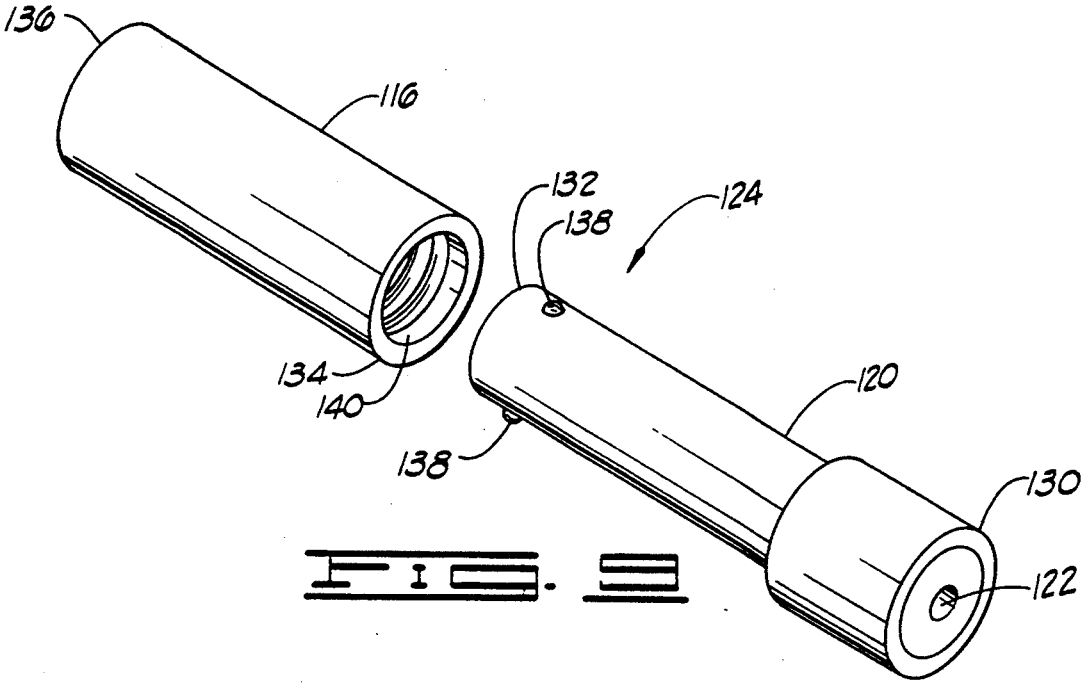
FIG. 9 Perspective view of an opened barrel lock showing locking bearings.

The purpose of the cleaning tool 10 of the embodiments previously described (tools 10*a*–10*e*) is to clear debris from a bore of a barrel lock. Prior to a detailed description of how the cleaning tool 10 is used, an explanation of a barrel lock and how a barrel lock is used are hereby provided. A typical barrel lock 124 is shown in FIG. 9 in an unlocked configuration. The lock 124 is comprised of a male end 120 and a female end 116. The male end 122 has a first end 130 and a second end 132. The female end 116 has a first end 134 and a second end 136. The male end 120 has a bore 122 which extends from the first end 130 of the male end 122 for a distance into the male end 122. The female end 116 has a bore 140 which extends from the first end 134 for a distance into the female end 116. The bore 140 of the female end 116 is sufficiently sized that the male end 124 can be inserted into the bore 140.

The barrel lock 124 is set into a locked configuration when the second end 132 of the male end 120 is inserted and firmly pushed into the bore 140 of the female end 116 such that the engaging means 138 (which in FIG. 9 are shown to be a pair of ball bearings) of the male end 124 lockingly engage with engaging means (not shown) within the bore 140 of the female end 116. When it is desired to unlock the lock 124, a key, such as of the type disclosed in U.S. Pat. No. 4,712,395 as referenced previously, is inserted into the bore 122 of the male end 120, the male end 120 previously having been inserted into the bore 140 of the female end 116 and engaged with the female end 116. It is the bore 122 of the male end 124 which frequently becomes obstructed by debris and must be cleaned out by the cleaning tool 10.

Figure 10:
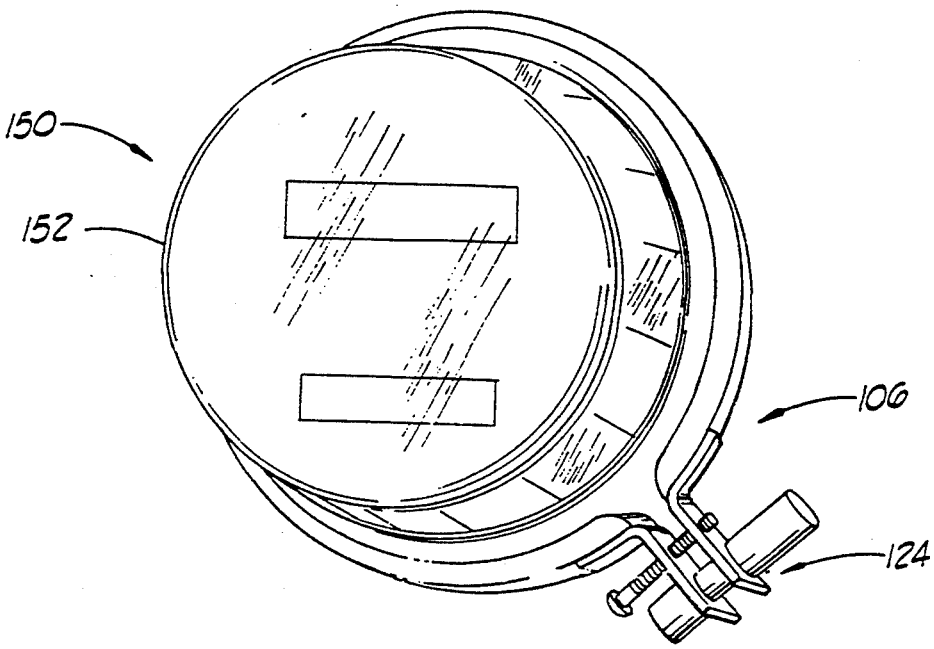
FIG. 10 Perspective view of retaining ring locked around a meter housing.

Barrel locks 124 of the type pertinent to this invention are usually used to lock a retaining ring around the rims of an electric metering box 150 such as shown in FIG. 10. In this configuration, a retaining ring and lock assembly is clasped in a locking fashion around a meter housing 152 and locked into place by a barrel lock 124.

Figure 7:
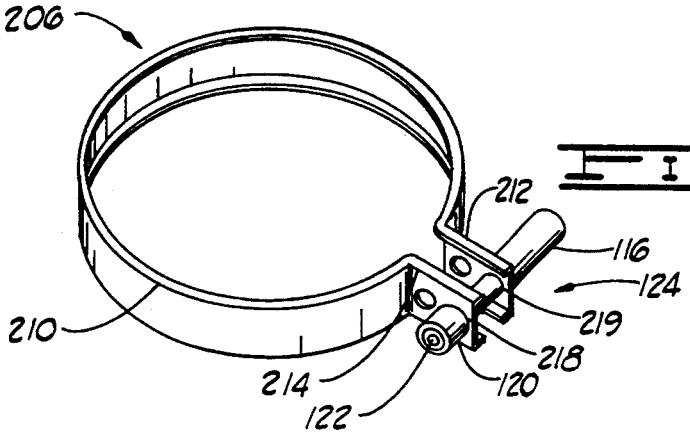
FIG. 7 Perspective view of meter locking retaining ring with barrel lock.

More specifically, a preferred embodiment of the manner in which the barrel lock 124 can resiliently engage a retaining ring is shown in FIG. 7. In this embodiment a retaining ring and lock assembly 206 is comprised of a ring 210 and lock, such as the lock 124 described previously in FIG. 9. The ring 210 has a first end 212 which has an aperture 219 and a second end 214 which has an aperture 218. To lock the ring 210, the male end 120 of the lock 124 is inserted first through the aperture 218 in end 214 then through the aperture 219 in end 212. The female end 116 of the lock 124 is held with the first end 134 of the female end 116 closely appressed to the aperture 219 of the end 212 and the male end 124 is then pushed firmly into the bore 140 of the female end 116 wherein the engaging means 138 of the male end 124 engage with the engaging means (not shown) of the female end 116 thereby locking the first end 212 of the ring 210 against the second end 214 of the ring 210.

Figure 8:
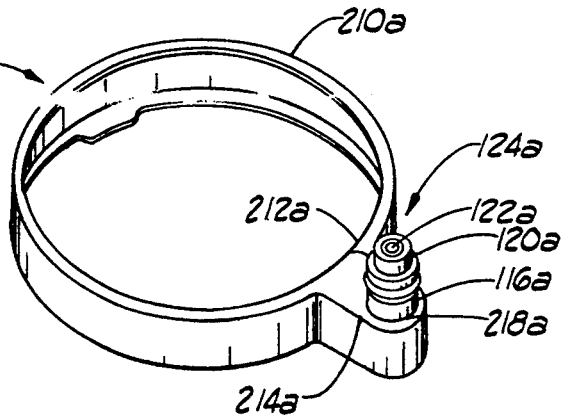
FIG. 8 Perspective view of another version of the barrel locking retaining ring with different version of barrel lock.

In another embodiment shown in FIG. 8, a retaining ring and lock assembly 206*a* is physically different but functionally similar to the assembly 206. The female end 116*a* of the lock is permanently connected to end 214*a* of the ring 210*a*. End 212*a* of ring 210*a* is brought in contact with end 214*a* and the male end 120*a* of the lock 124*a* is first inserted into the female end 116*a*of the lock 124*a* and then inserted in the ring end 212*a* whereby the engaging means 138 (not shown in FIG. 8) of the male end 120*a* expand beneath the opening in the end 212*a*, engaging end 212*a*, and thereby resiliently connecting and locking the first end 212*a* and the second end 214*a* of the ring 210*a* together.

As discussed previously, the purpose of the cleaning tool, as described in the embodiments described before, is to clear debris from the bore of a barrel lock used to lock a retaining ring around a meter housing prior to attempting to unlock the lock. The method of providing the tool 10 and cleaning the bore 122 of the male end 120 of the lock 124 which may or may not be in a locked configuration on a retaining ring 206 is hereby described.

The picking rod 20 of the tool 10 is inserted into the bore 122 and rotated and reciprocatingly moved up and down within the bore 122 of the lock 124 wherein the debris within the bore is engaged by the rod 20. This action serves to loosen particles of material which have become lodged within the bore 122 and would serve to obstruct the action of a key (not shown) whereby the barrel lock 124 could not be unlocked thereby causing the lock 124 to have to be cut off. After the pick rod 20 has engaged the debris within the male end 120 of the lock 124, the brushing rod 30 of the tool is inserted into the bore 122 and moved about wherein the debris is brushingly removed from the bore 122 of the lock 124.

Changes may be made in the embodiments of the invention described herein or in parts of the elements of the embodiments described herein without departing from the spirit and scope of the invention as defined in the following claims.

What is claimed is:

1. A method for cleaning debris from a bore of a male end of a barrel lock comprising:

providing a cleaning tool having a handle with a generally elongated shape, the handle having a first end and a second end, a first rod having a first end and a second end and shaped so as to be insertable into the bore of the male end of the barrel lock, the first end of the first rod connected to the first end of the handle, the second end of the first rod having a sharp point, a second rod having a first end and a second end, the first end of the second rod connected to one end of the handle and the second end of the second rod equipped with a brush insertable into the bore of the male end of the barrel lock;

inserting the second end of the first rod into the bore of the male end of the barrel lock so as to loosen debris in the bore of the barrel lock;

removing the second end of the first rod from the bore of the male end of the barrel lock;

inserting the second end of the second rod into the bore of the male end of the barrel lock and engaging the debris in the bore with the brush; and removing the second end of the second rod from the bore of the male end of the barrel lock so as to sweep the debris from the bore with the brush.

2. The method of claim 1 wherein the second end of the first rod in the step of providing a cleaning tool is curved near the second end thereof.

3. A method for cleaning debris from a bore of a male end of a barrel lock, comprising:

providing a cleaning tool comprising:

a rod assembly configured so as to be insertable into the bore of the male end of the barrel lock; and a handle with a generally elongated shape, the handle having a first end and a second end wherein at least one end of the handle is capable of receiving the rod assembly;

inserting the rod assembly into the bore of the male end of the barrel lock and engaging debris in the bore so as to loosen debris in the bore; and removing the rod assembly from the bore of the male end of the barrel lock thereby removing debris therefrom so as to provide a substantially debris-free bore.

4. The method of claim 3 wherein the rod assembly used in the step of providing a cleaning tool further comprises:

a first rod having a first end and a second end, the first end of the first rod being connected to one end of the handle, the second end of the first rod having a sharp point engagable with the debris so as to loosen the debris within the bore; and a second rod having a first end and a second end, the first end of the second rod being connected to one end of the handle, the second end of the second rod equipped with a brush engagable with the debris so as to remove the debris from the bore in the barrel lock, and wherein the step of inserting the rod assembly further comprises the steps of:

inserting the second end of the first rod into the bore of the male end of the barrel lock so as to loosen debris in the bore of the barrel lock;

removing the second end of the first rod from the bore of the male end of the barrel lock; and inserting the second end of the second rod into the bore of the male of the barrel lock and engaging the debris in the bore with the brush.

5. The method of claim 4 wherein the second end of the first rod in the step of providing a cleaning tool is curved near the second end thereof.

* * * * *